United States Patent [19]

Takasaki

[11] Patent Number: 4,909,666

[45] Date of Patent: Mar. 20, 1990

[54] DAMAGE-PROTECTING FLEXIBLE SHEET DAM

[75] Inventor: Mamoru Takasaki, Tokyo, Japan

[73] Assignee: Bridgestone Corporation, Tokyo, Japan

[21] Appl. No.: 385,959

[22] Filed: Jul. 28, 1989

Related U.S. Application Data

[63] Continuation of Ser. No. 146,865, Jan. 22, 1988, abandoned.

[30] Foreign Application Priority Data

Feb. 3, 1987 [JP] Japan ..... 62-21826

[51] Int. Cl.[4] ..... E02B 7/04

[52] U.S. Cl. ..... 405/115; 405/107; 428/902

[58] Field of Search ..... 428/902; 405/91, 115

[56] References Cited

U.S. PATENT DOCUMENTS

| | | | |
|---|---|---|---|
| 4,005,234 | 1/1977 | Stroupe | 428/36 |
| 4,048,362 | 9/1977 | Morihg et al. | 428/378 X |
| 4,243,714 | 1/1981 | Vanassche et al. | 428/257 X |
| 4,299,514 | 11/1981 | Muramatsu et al. | 405/115 |
| 4,605,586 | 8/1986 | Lane | 405/63 X |
| 4,619,553 | 10/1986 | Fischer | 405/72 X |
| 4,678,376 | 7/1987 | Gavin, Jr. et al. | 405/270 |
| 4,734,321 | 3/1988 | Radvan et al. | 428/902 X |
| 4,754,514 | 7/1988 | Limb et al. | 5/502 |

FOREIGN PATENT DOCUMENTS

| | | | |
|---|---|---|---|
| 0039521 | 3/1980 | Japan | 405/115 |

*Primary Examiner*—Randolph A. Reese
*Assistant Examiner*—Arlen L. Olsen
*Attorney, Agent, or Firm*—Sughrue, Mion, Zinn, Macpeak & Seas

[57] ABSTRACT

A damage-protecting flexible rubber sheet dam uses a wear-resistant, cut-resistant member having a corrosion resistance embedded in at least a part of an outer surface portion of a rubber dam body. The member mitigates and prevents damage of the outer surface portion due to wear and other various external injuries to prolong the durable life thereof.

5 Claims, 2 Drawing Sheets

DAMAGE-PROTECTING FLEXIBLE SHEET DAM

This is a continuation of application Ser. No. 146,865, filed Jan. 22, 1988, now abandoned.

BACKGROUND OF THE INVENTION

1. Field of the Invention

This invention relates to a flexible sheet dam arranged across a river or the like and inflated and deflated by supply and discharge of a fluid. More particularly it relates to a damage-protecting flexible sheet dam which can mitigate and prevent damage of its outer surface portion due to wear and various external injuries produced at the outer surface portion of the dam body during the use of the dam to prolong the durable life.

RELATED ART STATEMENT

The flexible sheet dam arranged across the river or the like, which is usually called as a rubber dam, is inflated by supplying a fluid to the inside of the dam body to dam the flow of the riverwater, or deflated by discharging the fluid filled in the dam body to permit flow of the dammed riverwater downstream.

In the inflation of such a rubber dam when driftwood or sand or small stone flow downward from upstream together with riverwater go over the top portion of the dam, they rub with the outer surface of this top portion. On the other hand, in the deflation of the rubber dam, large stones flow downward from the upstream due to heavy rain rotate on the outer surface of the dam toward downstream and press and collide thereto, whereby damage due to external force such as wear, scratch, stab, crush, tear and the like are caused in the outer surface portion of the dam.

Furthermore, there is a case that the dam is damaged by the human breaking action in such a manner that the dam is thrusted or cut by an edged tool such as a knife or the like.

For this end, there is proposed an embodiment of embedding metallic reinforcing members in the outer surface rubber portion of the rubber body for withstanding to the above wear and injury.

In FIG. 4 is shown a partly cutaway sectional view illustrating a deflated state of such a conventional rubber dam.

In the inside of the rubber dam body 01 is embedded a reinforcing layer 02 made from a canvas or the like along a central releasable split portion 01*a* so as to bend the reinforcing layer at the end of the releasable split portion in up and down directions.

Further, plural metallic reinforcing members 03 are embedded in the rubber body located above the releasable split portion 01*a* near the outer surface thereof in longitudinal direction (normal direction of the drawing).

Thus, the outer surface of the rubber dam exposed to driftwood, rotating stone and the like is protected by the metallic reinforcing members 03 to provide a rubber dam having improved wear resistance and cut resistance.

In such a rubber dam body 01 having the protecting performance, there is caused the generation of rust on the surface of the metal due to the long use of the metallic reinforcing member 03 and occurrence of corrosion due to the penetration of water through cut damage or through-hole in the outermost surface rubber portion, resulting in the degradation of the reinforcing member itself, the peeling of the metallic reinforcing member from the surrounding rubber or the like. This brings about the decrease of the protecting performance in the basic structure of the rubber dam body and other bad factors, which undesirably degrades the durability of the rubber dam.

SUMMARY OF THE INVENTION

It is an object of the invention to solve the aforementioned drawbacks of the conventional techniques and to enhance the protecting performances of the flexible rubber sheet dam against damage to thereby prevent the damage loss thereof and prolong the durable life.

According to the invention, there is the provision of a damage-protecting flexible sheet dam arranged across a river or the like and inflated and deflated by supply and discharge of a fluid, characterized in that at least a part of an outer surface rubber portion of a rubber body in said flexible sheet dam is integrally embedded with a wear-resistant, cut-resistant member having corrosion resistance.

According to the above construction, the function against external infringement factors can be given to the outer surface layer of the rubber sheet dam body having inflatable and deflatable performance through fluid supply and discharge by the embedment of the wear-resistant, cut-resistant member having the corrosion resistance, and also the degradation of the durability due to the structure breakage such as rust generation, corrosion phenomenon, peeling and the like based on the change of time and change of embedment environment in the conventional metallic reinforcing member can be prevented because the wear-resistant, cut-resistant member has the corrosion resistance.

BRIEF DESCRIPTION OF THE DRAWINGS

The invention will be descried with reference to the accompanying drawings, wherein.

DESCRIPTION OF THE PREFERRED EMBODIMENTS

The invention will be described with reference to an embodiment shown in FIGS. 1 to 3.

Figure 1:
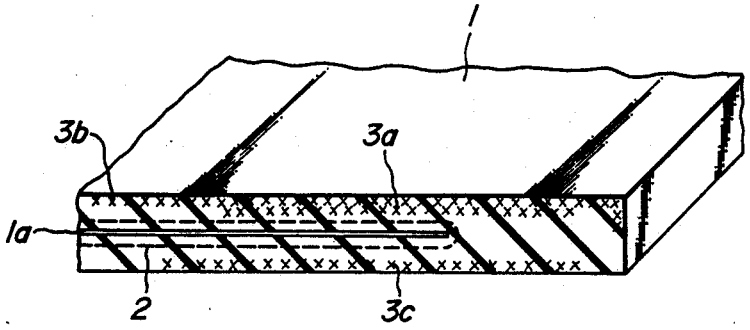
FIG. 1 is a partly cutaway perspective view of an embodiment of the flexible sheet dam according to the invention.

FIG. 1 shows a partly cutaway perspective view of the rubber sheet dam body 1 at a deflated state. In the rubber sheet dam body 1 made of a belt-like rubber bag and provided at its center with a releasable split portion 1*a*, a reinforcing fiber layer 2 is embedded at a position surrounding the releasable split portion 1*a* likewise the case of the conventional dam body.

Furthermore, Kevlar fibers (trade name of aromatic polyamide fiber) are embedded near upper and lower surface portions of the rubber dam body 1, respectively.

Particularly, the thickness of the Kevlar fiber 3*a* located at a region side front end of the upper outer surface portion of the rubber dam body 1 is thicker than those of the other Kevlar fibers 3*b*, 3*c*.

The Kevlar fiber is a material having not only corrosion resistance but also excellent tensile properties, wear resistance and cut resistance.

In addition to the Kevlar fiber, ceramic whiskers or other materials having excellent corrosion resistance, wear resistance and cut resistance may be used.

The rubber sheet dam body 1 embedded with the Kevlar fiber (or ceramic whisker) is manufactured by folding a belt-like woven fabric made from cotton, synthetic fiber or the like to form a lapped fabric, impregnating green rubber into the lapped fabric, integrally placing a proper sheet formed by kneading Kevlar fibers or ceramic whiskers with green rubber on a given position of the fabric, and curing them to form a belt-like rubber sheet.

According to experiments, it has been confirmed that chips of 0.5~3 mm in diameter and 2~5 mm in length are most excellent in the workability and effective against cut damage as the size of the Kevlar fiber or ceramic whisker.

Figure 2:
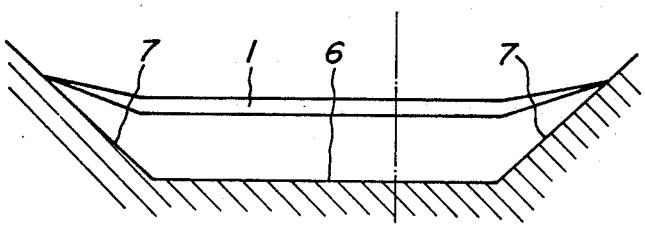
FIG. 2 is a front view showing an inflated state of the dam of FIG. 1.
Figure 3:
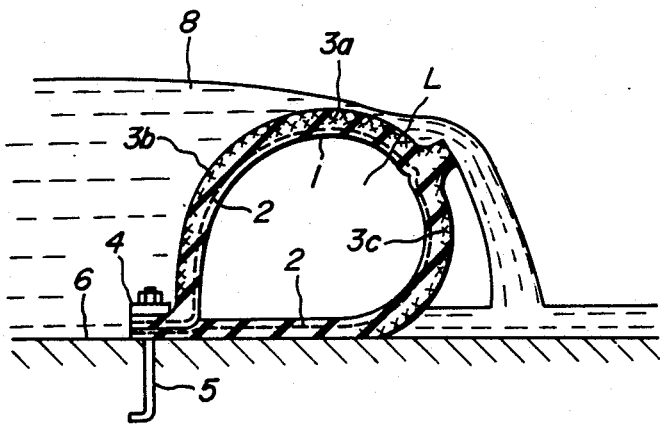
FIG. 3 is a side view of FIG. 2.
Figure 4:
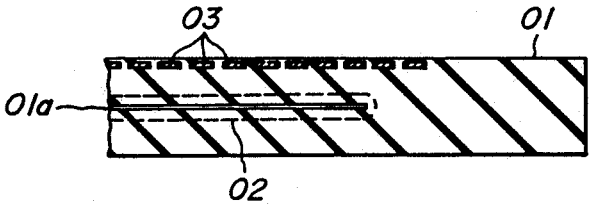
FIG. 4 PRIOR ART
FIG. 4 is a partly cutaway sectional view of the connectional rubber dam body.

The free releasable end at the folded state of the rubber sheet dam body 1 is located at upstream side and airtightly and liquid-tightly secured to a riverbed portion 6 and both riverbank portions 7 each made of a concrete through a pushing fit 4 and anchor bolts 5 to form an airtight flexible bag body (see FIGS. 2 and 3).

Since the rubber dam body 1 is formed by the one-piece press shaping of belt-like body, it is always flat in the deflated state as shown in FIG. 1, so that the cut damage due to the rotating stones is hardly caused and the wear resistance and durability can be enhanced without obstructing the flowing of riverwater.

As shown in FIG. 3, in an inflated state that a fluid L is supplied to the inside of the rubber dam body 1, since the Kevlar fibers are embedded over substantially a whole of the rubber dam body 1 at the upstream side and the thickness of the upper Kevlar fiber 3*a* at an overflowing position of riverwater 8 is most thick, so that the cut-resistant effect becomes largest.

Therefore, the cut resistance at the portion liable to cause cut damage due to the collision of driftwood or the like floating in riverwater is excellent, so that the durability can be enhanced.

Moreover, the Kevlar fiber 3*b* embedded in the remaining portion at the upstream side of the rubber dam body 1 serves to prevent occurrence of wear and cut damage due to the collision of stones rotating on the riverbed.

And also, when the flow of riverwater is completely dammed at the inflated state of the dam body, the downstream side of the dam body 1 is at an exposed state and is apt to be intentionally cut by a knife or the like. For this end, the Kevlar fiber 3*c* is also embedded in the portion at the downstream side of the dam body for preventing the human breaking damage.

Since the Kevlar fiber is not damaged by cutting with an ordinary knife or the like, it is possible to prevent the intrusion of knife edge into the inside of the dam body.

Furthermore, when the coating rubber of the rubber dam body 1 is cut out by the knife to expose the Kevlar fiber, there is no occurrence of rust nor change of quality with lapse of time in the Kevlar fiber itself, so that the degradation of the reinforcing member due to the quality change and the peeling accompanied therewith are not caused. Consequently the rubber dam body having an excellent durability can be obtained.

As mentioned above, according to the invention, the wear-resistant, cut-resistant member having the corrosion resistance is integrally embedded in given portions of the flexible sheet dam body. The wear resistance and cut resistance can be improved and also the corrosion resistance can be provided to largely prolong the durable life of the sheet dam body.

What is claimed is:

1. A damage-protecting flexible sheet dam comprising: a rubber sheet dam body provided at its center with a releasable split portion and a reinforcing fiber layer embedded at a position surrounding the releasable split portion, said dam body arranged across a body of water and inflated and deflated by supply and discharge of a fluid, at least a part of an outer surface rubber portion of said body in said flexible sheet dam in addition to said reinforcing layer is integrally embedded with a wear-resistant, cut-resistant member having corrosion resistance and including a material having a diameter of 0.5–3 mm and a length of 2–5 and selected from the group consisting of aromatic polyamide fiber and ceramic whiskers.

2. The flexible sheet dam of claim 1 wherein said cut-resistance member is thicker at an upper outer surface portion when said dam is inflated than remaining outer surface portions in which said member is integrally embedded.

3. The flexible sheet dam of claim 2 wherein said upper outer surface portion is in an upstream region of said dam over which water flows when said dam is inflated.

4. The flexible sheet dam of claim 1 wherein said cut-resistant member is a belt-like woven fabric impregnated with rubber having said material impregnated therein.

5. The flexible rubber sheet of claim 1 further comprising means to secure said dam to the floor of said body of water in an airtight manner.

* * * * *